United States Patent [19]

Kamei et al.

[11] Patent Number: 4,577,277

[45] Date of Patent: Mar. 18, 1986

[54] METHOD AND APPARATUS OF CONTINUOUS CASTING BY THE USE OF MOLD OSCILLATING SYSTEM

[75] Inventors: Futoshi Kamei; Shinichi Harada, both of Kobe; Akira Yasunishi, Hyogo; Minoru Takemura, Kobe; Takeshi Fujikawa, Hyogo; Shinzo Iida; Yasuyuki Katayama, both of Kobe, all of Japan

[73] Assignee: Kabushiki Kaisha Kobe Seiko Sho, Kobe, Japan

[21] Appl. No.: 525,896

[22] Filed: Aug. 24, 1983

[30] Foreign Application Priority Data

Mar. 7, 1983 [JP] Japan ..... 58-37169
Jul. 22, 1983 [JP] Japan ..... 58-134962

[51] Int. Cl.[4] ..... B22D 11/04

[52] U.S. Cl. ..... 364/472; 164/416; 164/478

[58] Field of Search ..... 164/260, 418, 416, 459, 164/478; 364/151, 154, 472, 174, 176, 166, 183, 165; 318/611, 632

[56] References Cited

U.S. PATENT DOCUMENTS 3,523,571 8/1970 Niskovskish ..... 164/416
3,638,714 2/1972 Newhall ..... 164/416
3,664,409 5/1972 Kolomeitsev et al. ..... 164/416
3,700,024 10/1972 Knell ..... 164/478
4,237,962 12/1980 Perratore et al. ..... 164/416
4,438,803 3/1984 Takeuchi et al. ..... 164/478
4,480,678 11/1984 Cazaux et al. ..... 164/416

OTHER PUBLICATIONS

Industrial Noise and Vibration Control; J. D. Irwin and E. R. Graf; pp. 279-283; Prentice-Hall; 1979.

*Primary Examiner*—Jerry Smith
*Assistant Examiner*—Allen MacDonald
*Attorney, Agent, or Firm*—Oblon, Fisher, Spivak, McClelland & Maier

[57] ABSTRACT

A method and apparatus of continuous casting with the use of a mold oscillating system adapted to oscillate a casting mold supported by a oscillating frame, the method including oscillating the mold by applying vibration at a preselected frequency higher than the natural frequency of the oscillating system; and increasing the amplitude of applied oscillation to a value in a range as determined by the ratio of a length of time of a downward movement period of the mold to a time length in which the speed of the mold exceeds the casting speed during the downward period. Preferably the preselected frequency of applied oscillation of the mold is approximately 1.5 times higher than the natural frequency of the oscillating frame.

5 Claims, 15 Drawing Figures

METHOD AND APPARATUS OF CONTINUOUS CASTING BY THE USE OF MOLD OSCILLATING SYSTEM

BACKGROUND OF THE INVENTION

1. Field of the Invention

This invention relates to the production of continuously cast metal strands through a mold, and more particularly to a method and an apparatus for continuously casting a defect-free strand by oscillating a mold supporting oscillating frame by an electrohydraulic or mechanical drive means.

2. Description of the Prior Art

In a continuous casting process, it is necessary to prevent the problems of seizure or breakout of the cast strand by reducing the friction between the mold and the cast strand. In this regard, it has been the general practice to resort to the so-called mold oscillating system which reduces the friction between a mold and a cast strand by oscillating the mold in the vertical direction during the casting operation.

Generally, in the casting operation using a mold oscillating system, the mold is oscillated such that the maximum speed of the downward movement of the mold is greater than the strand withdrawing speed. More specifically, as shown in the diagram of the downward mold speed versus the cast strand withdrawing speed of FIG. 1, the oscillation of the mold is set so that the ratio of the time length tn in which the downward speed of the mold is greater than the strand withdrawing speed to the time length tp of the downward mold movement ($tn/tp. \times 100$) is in the range of 60% to 80%.

With regard to more specific conditions of oscillation, it has been the conventional practice to set the frequency of oscillation at 60–90 C/min and the amplitude of oscillation at 6–10 mm. However, under such conditions, there often occur positive and negative defective structures at the roots of the oscillation mark, which will invite fine cracks, in addition to the defects due to powder inclusion.

The oscillation defects which occur at the roots of the oscillation mark mainly exist in the surface layer within the depth of 2 mm, so that, if a cast strand is rolled into a sheet without any prior treatment, the defects come out as an irregular pickling pattern and surface defects, thus impairing the surface quality of the resulting steel sheet to a considerable degree. Therefore, according to the conventional procedure, these defects are removed by a grinding operation in the stage of intermediate products, which will obviously result in unacceptably high production costs due to the increase in expenses for defect removing treatment and reductions in yield.

In this connection, FIG. 2 shows the relationship between the rate (%) of occurrence of the oscillation defects of the cast strand and the frequency of oscillation C/min. As shown in the figure, it has been known that the rate of oscillation defects can be reduced by increasing the frequency of oscillation. However, the increase of frequency has been limited to a certain level since a high oscillation frequency has possibility of inducing so-called "sloshing", surfacewise oscillations of molten steel, as well as the resonance of the oscillation system of the oscillating frame at its natural frequency.

SUMMARY OF THE INVENTION

With the foregoing situations in view, the present invention has as its object the provision for a method and an apparatus for continuous casting with the use of a mold oscillating system which can eliminate the problems of the above-mentioned oscillation defects and sloshing.

It is a more particular object of the present invention to provide a method and apparatus for continuous casting, which permits selection of the frequency of mold oscillation arbitrarily from a broad range without the above-mentioned problems.

It is another object of the present invention to provide a method and apparatus for continuous casting, employing an electrohydraulic or mechanical oscillating means which is controlled so as to oscillate the mold correctly at a preselected amplitude and frequency.

According to one aspect of the present invention, there is provided a method of continuous casting with the use of a mold oscillating system adapted to vibrate a casting mold supported by a oscillating frame, the method comprising oscillating the mold at a preselected frequency higher than the natural frequency of the oscillating system; and then increasing the amplitude of oscillation of the mold to a value in a range as determined by the ratio of a time length of a downward period of the mold to a time length in which the speed of movement of the mold exceeds the casting speed during the downward period. Preferably the preselected frequency of applied oscillation is approximately 1.5 times higher than the natural frequency of the oscillation system. Throughout the written description and the claims, it will be understood that references to the "system" in phrases such as "oscillating frame system", "oscillating system" and "oscillating system of the frame" refer to that which is organically connected to the frame to produce a system having a characteristic natural frequency.

According to another aspect of the present invention, there is provided a method of continuous casting by the use of a oscillating system adapted to oscillate a mold supported on a oscillating frame substantially of U-shape in plan view having the free ends of opposite side frame portions thereof pivotally supported on a pivoting shaft and being vibrated up and down by an oscillator connected to a center portion a transverse frame portion thereof, the method comprising determining the rigidity of the vibratory frame such that the natural frequency of the vibratory frame is at least 6 times greater than the frequency of oscillation applied by the oscillator.

According to still another aspect of the present invention, there is provided a method of continuous casting as mentioned above, employing for the oscillator an electrohydrualic servo having a cylinder thereof connected to the vibratory frame and driven according to an oscillation signal of preselected amplitude and frequency produced by a function generator to oscillate the mold, the method further comprising converting a position signal of the cylinder into an amplitude signal; calculating the amount of deviation of the amplitude signal from the value of the preselected amplitude; and multiplying the amount of deviation by a coefficient and adding the same to the preselected amplitude to produce a fresh amplitude signal to be applied to the function generator.

The present invention also provides an appratus for carrying out the above-mentioned continuous casting method.

The above and other objects, features and advantages of the present invention will become apparent from the following description and the appended claims, taken in conjunction with the accompanying drawings which show by way of example of some illustrative embodiments of the invention.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 3:
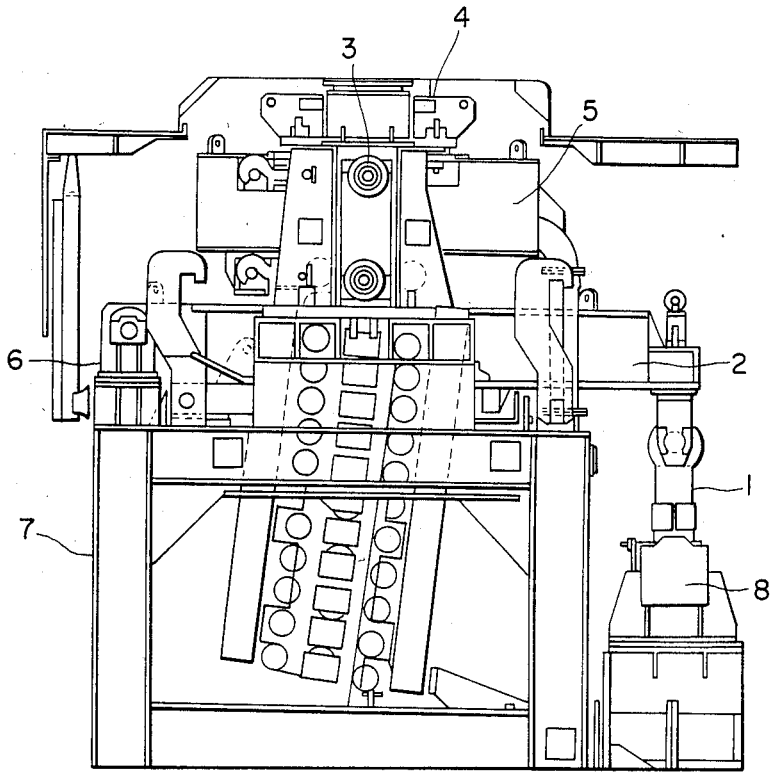
FIGS. 3 and 4 are a side view and plane view, respectively, of a casting machine employed for carrying out the continuous casting method according to the invention.
Figure 4:
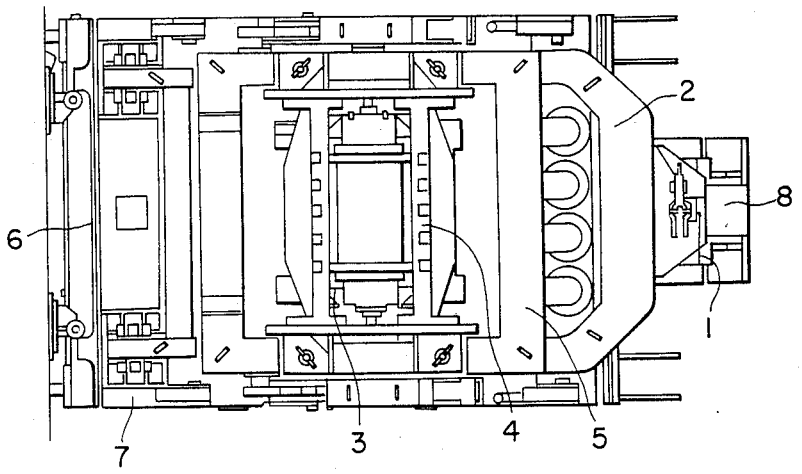

Referring to the accompanying drawings and first to FIGS. 3 and 4, there is shown an essential part of a casting machine which is suitable for carrying out the continuous casting by the use of a mold oscillating system according to the present invention, wherein indicated at 4 is a mold which is supported on a vibratory frame 2 along with a water feed frame 5 provided on the lower outer periphery of the mold 4. The oscillating frame 2 has the ends of its opposite side portions povitally supported on a stationary machine frame 7 at oscillational fulcrum points 6 and has the center portion of its transverse portion securely connected to an exciting cylinder 1 of an electrohydraulic servo unit 8 mounted on the base of the frame 7 on the other side of the machine so that the oscillation system of the frame 2 including the mold 4 is oscillated about the fulcrum points 6 relative to the machine frame 7 through a oscillation guide 3 by the action of the exciting cylinder 1. The drive of the electrohydraulic servo 8 is controlled by an electric control circuit which will be described hereinafter and which is capable of separately controlling the frequency and amplitude of oscillation.

Figure 5:
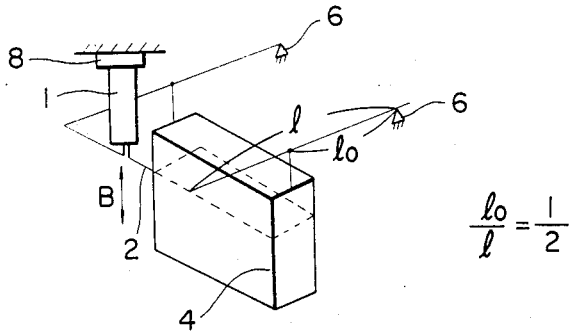
FIG. 5 is a schematic illustration explanatory of the construction of the casting machine of FIG. 3.
Figure 6:
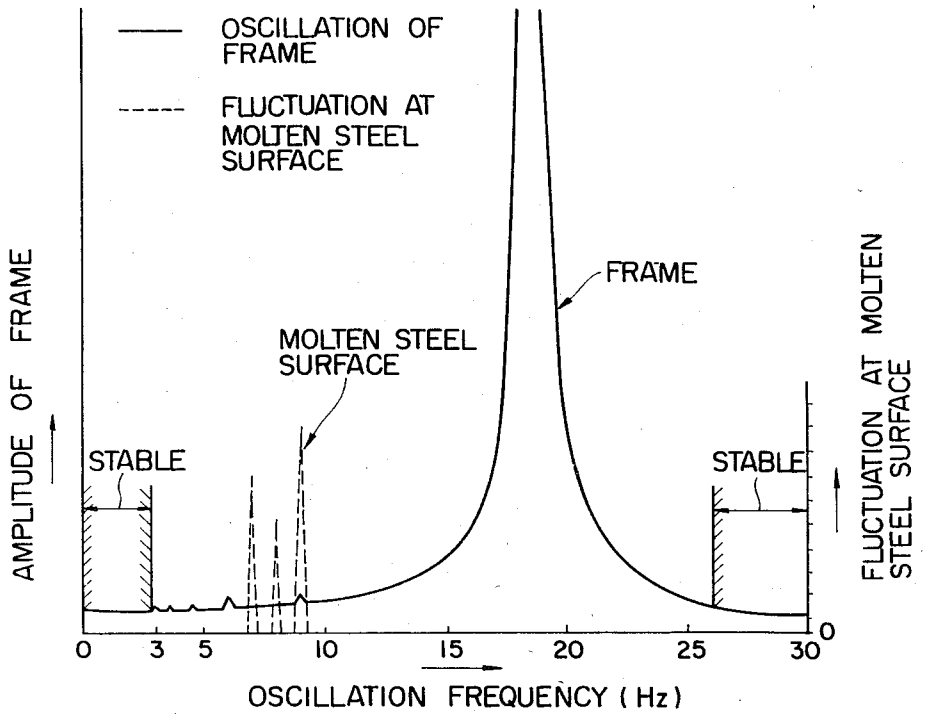
FIG. 6 is a diagram showing the characteristics curves of oscillations of the frame and the molten steel surface in the mold of the casting machine of FIG. 3.

The above-mentioned oscillation system of the oscillating frame 2 including the mold 4 is schematically shown in FIG. 5. In this case, the responsive magnification F(x) of the frame in such a vibration system is expressed by $$F(x) = \frac{A}{\frac{1}{2}B} \tag{1}$$

where A is the response amplitude of the mold and B is the amplitude of vibration applied by the exciter 1. In the oscillation system of the frame 2 shown in FIG. 5, the oscillation of the frame 2 and the fluctuations on the surface of molten steel in the mold are induced according to the frequency of applied oscillation as shown in FIG. 6. When the applied frequency is $\omega$ and the resonance frequency of the oscillation system of the frame 2 is $\omega_0$, its oscillation frequency ratio F(r) is expressed by $$F(r) = \omega/\omega_0 \tag{2}$$

As seen in the diagram of FIG. 6 in which the vertical axis represents the response magnification F(x) of the oscillation system of the frame 2 and the horizontal axis the applied vibration $\omega$ or the oscillation ratio F(x) of the oscillation system of the frame 2, there appears a wave (indicated by solid line) with a maximum frequency of oscillation at the natural frequency of the oscillation system of the frame 2 and the next large frequency at a resonance frequency of the oscillation system. Therefore, for instance, if the applied frequency is taken on the horizontal axis in FIG. 6, the response magnification of the oscillation system of the frame 2 is unstable and is largely varied in a frequency range of 3 Hz to 26 Hz, giving rise to various problems. However, at frequencies outside that range, namely, at a frequency lower than 3 Hz or higher than 26 Hz, the response magnification of the oscillation system of the frame 2 is small and stable enough for actual use. On the other hand, the freuency F($\omega$) of natural vibration at the molten steel surface is expressed by $$F(\omega^2) = \sqrt{\frac{5}{2}} \cdot \frac{g}{In} \tan h\left(\sqrt{\frac{5}{2}} \cdot \frac{h}{In}\right) \text{ (rad/sec)}^2 \tag{3}$$

when the thickness or width in section of the mold is 2I, the depth of molten steel is h (holding that h=1.5I when h/I>1.5), the gravitational acceleration is g, and the degree is n. Whereas, the frequency f of oscillation is expressed by $f=2\pi\omega$(Hz). Accordingly, the oscillation at the molten steel surface is influenced by the dimensions in section of the mold and the frequency of the applied oscillation, and takes place at a point where the frequency of its natural vibration F($\omega$) coincide with the applied frequency N in an n-multiplied range. In FIG. 6, if the fluctuation at the molten steel surface is taken on the vertical axis and the frequency of applied oscillation on the horizontal axis, there appear the waves as indicated by broken line in that figure.

Namely, those type of waves occur when the frequency of the applied oscillation is in the range of 3 Hz to 26 Hz, and do not occur at frequencies outside that range, thus maintaining stability at a frequency lower than 3 Hz or higher than 26 Hz. It is known from this fact that the range of high frequencies which can oscillate the mold stably free of the influences of the resonance of the oscillation system of the frame and the fluctuations at the molten steel surface is higher than 26 Hz. In this regard, it has been experimentally confirmed that there occur no problems, especially when the frequency of the applied vibration is approximately 1.5 times greater than the natural frequency of the oscillation system of the frame.

Figure 1:
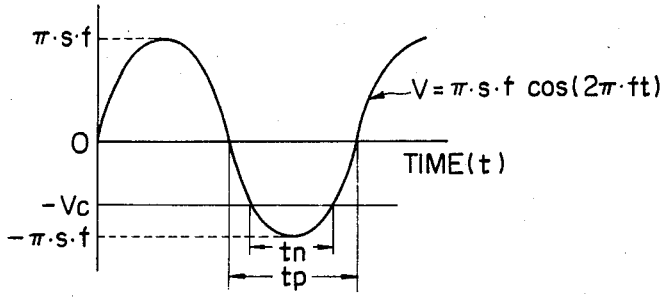
FIGURE 1 PRIOR ART
FIG. 1 is a diagram showing the relationship between the mold oscillating speed and the cast strand withdrawing speed and time.
Figure 2:
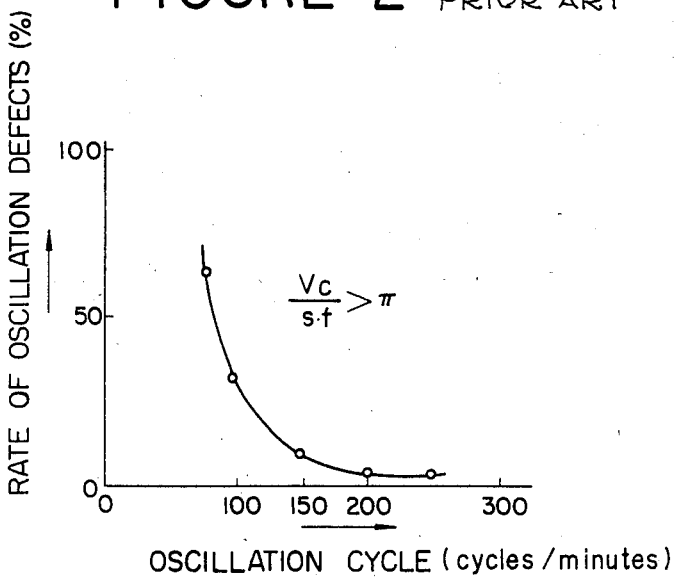
FIGURE 2 PRIOR ART
FIG. 2 is a diagram showing the influence of the oscillation frequency on the rate of oscillation defects.
Figure 7:
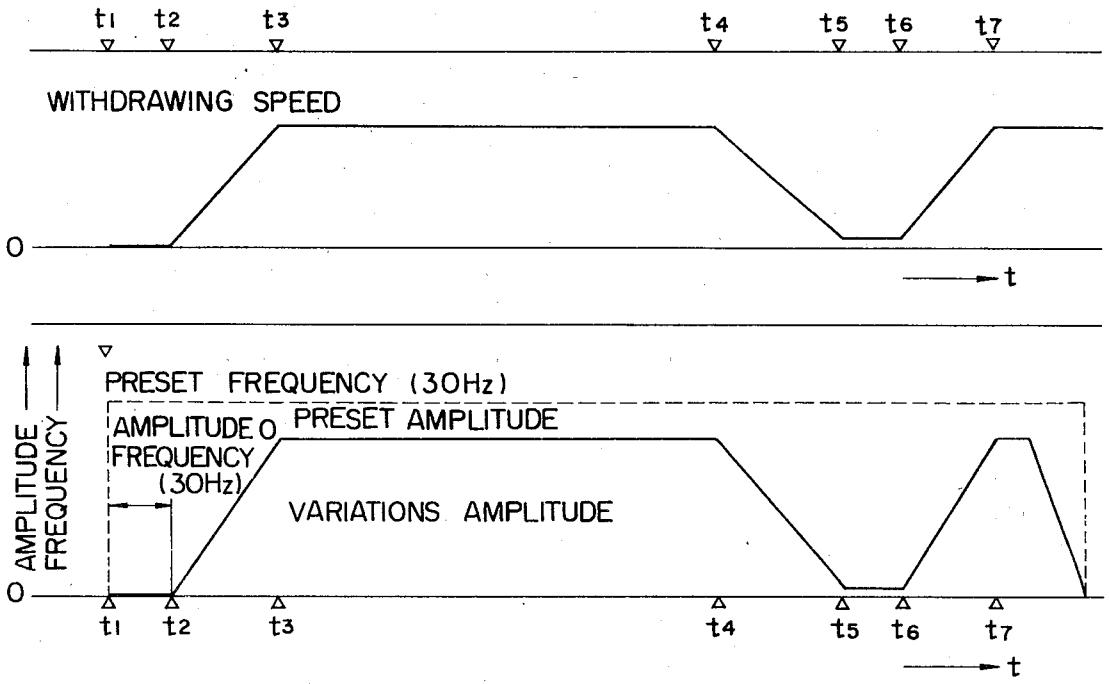
FIGS. 7(*a*) and 7(*b*) are diagrams showing the cast strand withdrawing speed in relation to the oscillation of the mold.

In order to oscillate the oscillation system including the frame and mold at a frequency higher than their natural frequency, the amplitude of the oscillation should be held at a minimum, preferably near a zero level if possible, until its frequency exceeds the frequency of the problematic natural oscillation so that no problems are caused by the large resonance of the oscillation system while the applied oscillation is raised to the required high frequency. Therefore, in a mold oscillating system according to the present invention, the oscillation which is applied to the oscillation system by the electrohydraulic servo 8 through the exciting cylinder 1 is controlled solely with regard to its frequency in the initial stage of oscillation of the mold. It is only after the frequency has been raised from zero to a required high level by the control circuit that the amplitude of the oscillation to be applied to the oscillation system of the frame is raised from near zero to a predetermined value, to begin application of oscillation to the oscillation system of the frame at a frequency higher than that of natural oscillation of the frame. In other words, the oscillation to be applied to the oscillation system of the system is controlled by the two-step operation of the control circuit, raising the frequency in the first place and then increasing the amplitude. Therefore, for example, in a case where the cast strand withdrawing speed is scheduled to be zero at a casting start point t1, accelerated from a withdrawal start point t2 to a point t3 at which a preset withdrawing speed is reached, kept at the preset speed until a speed-down instruction point t4, lowered to zero from the point t4 to a head solidifying point t5, and accelerated again from a re-withdrawing point t6 to a point t7 at which a cast strand is passed through the mold, as shown in FIG. 7(*a*), the oscillation to be applied to the mold supporting frame 2 from the electrohydraulic cylinder 8 through the exciting cylinder 1 is immediately raised to a required frequency, for instance, to 30 Hz at point t1 as shown in FIG. 7(*b*) and thereafter maintaining at that frequency. On the other hand, the amplitude of the oscillation is maintained at near zero at the time point t1, gradually increased from the time point t2 to reach a preset amplitude, for instance, an amplitude of 1.5 mm at the time point t3, maintained at the amplitude of 1.5 mm until the time point t4, reduced from the time point t4 to near zero at the time point t5, and increased again at the time point t6 to reach 2.2 mm at the time point t7. The oscillation to be applied to the frame 2 is preferred to have a frequency 1.5 times greater than the frequency of natural oscillation of the system, and normally set at a frequency higher than 25 Hz, while the amplitude which is preferred to be as small as possible is normally set at a value smaller than 2 mm. The downward speed of movement of the mold and the cast strand withdrawing speed are determined in the same manner as in the conventional method (FIG. 1).

As is clear from the foregoing embodiment, the mold oscillating system for continuous casting according to the present invention is characterized in that the mold is oscillated by an electrohydraulic servo which is controlled to start the applied oscillation at a preset frequency higher than the natural frequency of the oscillation system and then to increase the amplitude of the applied oscillation to a value in a range as determined by the ratio of the time length of a downward period of the mold movement to the time length in which the speed of the mold movement is higher than the casting speed in the downward period. Preferably, the frequency of applied vibration is preset at a value approximately 1.5 times greater than the natural frequency of the oscillation system of the frame. Thus, the aforementioned objectives of the invention can be achieved by a very simple means, particularly the objective of oscillating the mold at a frequency higher than that of the natural frequency of the system to permit continuous casting of slabs and blooms which are free of oscillation defects and which require no defect-removing treatment prior to rolling. Steel sheets obtained from slabs which were produced according to the method of the present invention bore almost no defects and showed a yield of 99% on average. Further, as mentioned hereinbefore, the method of the present invention permits the selection of the frequency and amplitude of the mold oscillation arbitrarily from a broad range which conventional methods could not provide, so that it becomes possible to perform the mold oscillating operation in a simple and secure manner in the continuous casting process. The cast strand can be effectively oscillated without causing oscillation defects thereto by setting the mold oscillation at a high frequency, and the amplitude of mold oscillation can be set at a small value which would not require an objectionably high rigidity of the frame and permit economical design of the oscillation system.

Figure 8:
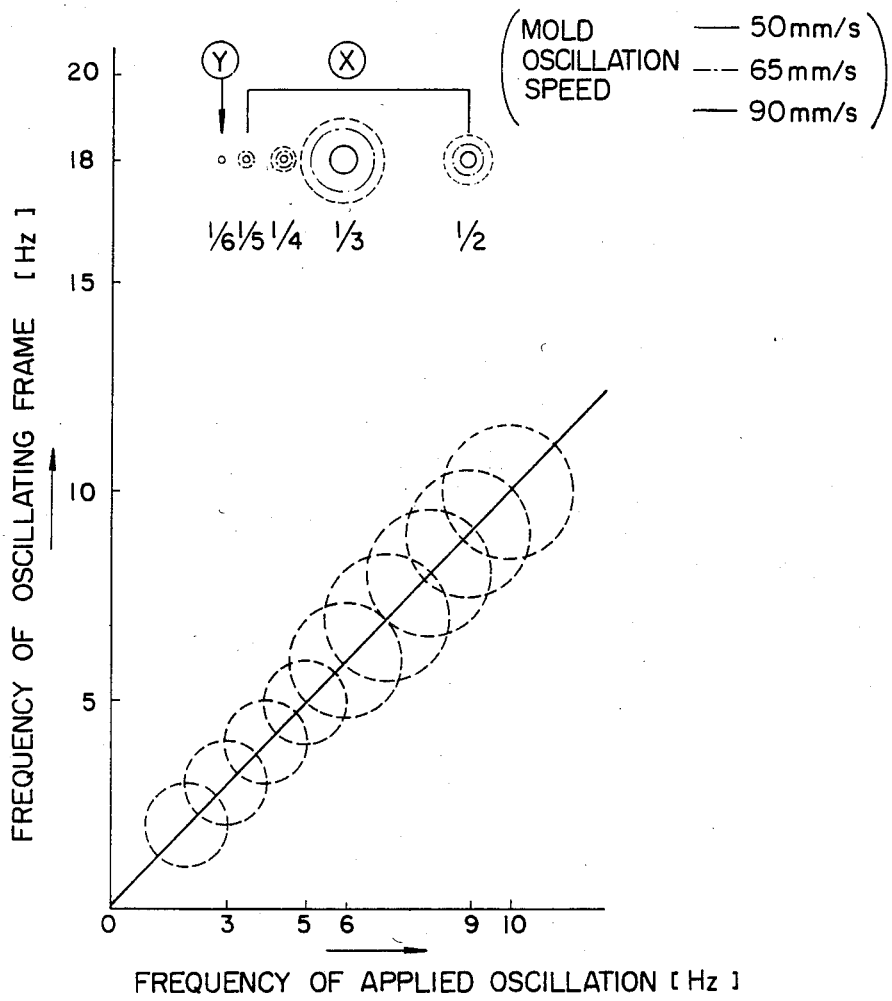
FIG. 8 is a Cambell diagram showing the relationship between the frequency of applied oscillation and the frequency of oscillating frame.

FIG. 8 shows the results of tests studying the amplitudes of oscillations of the frame 2 and the molten steel in the mold which were oscillated by the mold oscillator as shown in FIG. 5, using a mold of 900 mm in width and 250 mm in thickness and a oscillating frame 2 with the natural frequency at 18 Hz. As is clear from FIG. 8, when the frequency of oscillation is set at 6 Hz which is $\frac{1}{3}$ of the natural frequency of the frame 2, there occurs an extremely large natural frequency as indicated by symbol X. As the frequency of oscillation is reduced from 4.5 Hz ($\frac{1}{4}$ of the natural frequency of the frame) to 3.6 Hz (1/5), the natural frequency of the frame 2 is reduced gradually although it is still at a high level. If the frequency of oscillation is lowered to 3 Hz which is 1/6 of the natural oscillation, there occurs only an extremely small oscillation as indicated by symbol Y. With a still lower frequency of oscillation, no resonance occurs to the frame 2. On the other hand, the fluctuations (sloshing) of the surface of molten steel in the mold which is governed by the sectional dimensions of the mold and the frequency of oscillation take place at a range where the frequency of natural oscillation of the frame coincides with the frequency of oscillation in a particular range, namely, at a point where the former is n-times ($\frac{1}{2}$, $\frac{1}{3}$) greater than the latter.

The foregoing test results reveal that, in order to preclude resonance of the oscillating frame, it is essential to arrange the oscillating frame to have a natural frequency more than 6 times greater than the frequency of oscillation to be applied thereto since otherwise a large resonance would occur to the frame, causing irregular vibrations to the mold and rippling at the surface of the molten steel. Consequently, in a case where the oscillation is to be applied in a frequency range of approximately 0 to 3 Hz and at a frequency lower than that of the intrinsic vibration of the frame, it suffices to design the frame to have a natural frequency at a level at least 6 times higher, namely, at a frequency of or higher than $3\times6=18$ Hz. In a case where a natural more than 6 times that of the oscillation is employed, it may be in the vicinity of the hexaploid frequency (i.e., in the vicinity of 18 Hz) to preclude the influences of resonance, and there is no necessity of using more than a 10 times greater natural frequency as in the conventional methods.

Figure 9:
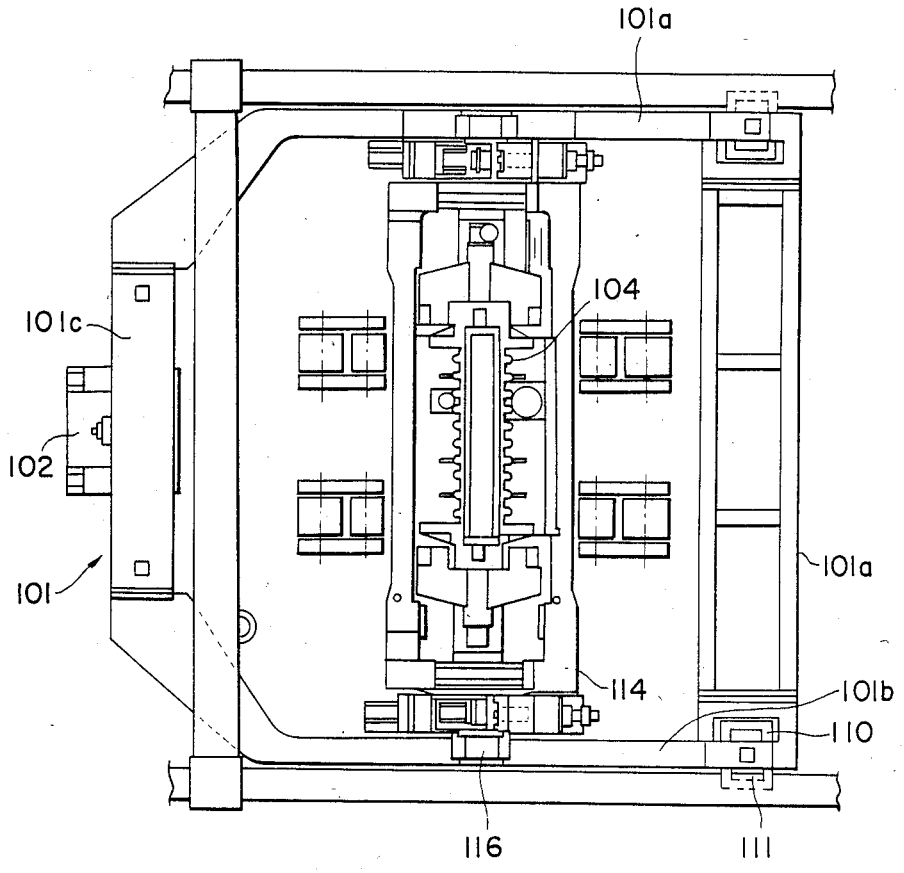
FIGS. 9 and 10 are a schematic plan and front views, respectively, of another embodiment of the continuous casting machine according to the invention.
Figure 10:
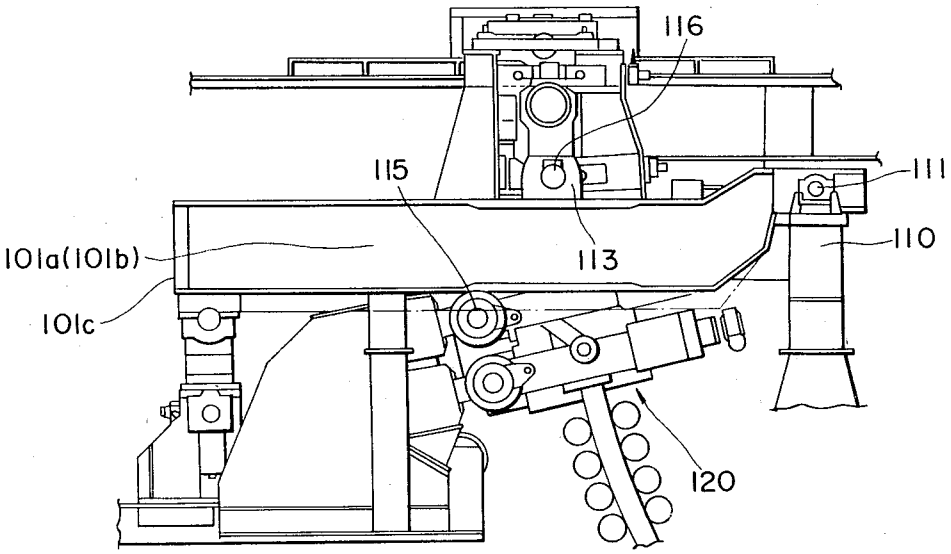

FIGS. 9 and 10 show an embodiment employing a oscillating frame with a natural frequency at 18 Hz and adapted to apply oscillation thereto by an oscillator in a frequency range of 0 to 3 Hz. In this embodiment, the free end portions of side portions 101*a* and 101*b* of an oscillating frame 101 are rockably supported on a support frame 110 through a pivoting shaft 111 and connected with each other by a link frame 101*d*. The transverse beam portion 101*c* of the oscillating frame 101 is connected at the lower center portion thereof to a rod of an oscillator 102 to thereby rock the side portions 101*a* and 101*b* up and down about the pivoting shaft 111. Projectingly provided at the center portions of the side frames 101*a* and 101*b* are brackets 113 the upper ends of which are securely connected through support shafts 116 to the opposite sides of and an outer mold frame integrally provided with a mold 104. Thus, the mold can be oscillated up and down by operation of the oscillator 102.

Since the oscillating frame 101 is designed to have a natural frequency six times greater than the frequency of oscillation caused by the oscillator 102, it has no possibility of interfering with a cast strand guide roll drive mechanism 120 which is provided beneath the side portions 101*a* and 101*b* of the oscillating frame 101. Interference with the strand guide mechanism 115 occurs as indicated by a chain line in the figure when the natural frequency of the oscillating frame 101 is more than 110 times greater than the frequency of oscillation as in the conventional method.

Thus, in the foregoing embodiment, the oscillating frame is designed to have a natural frequency more than 6 times greater than the frequency of oscillation, and at approximately 6 times greater natural frequency, it becomes possible to reduce the weight tonnage of the oscillating frame as compared with the conventional counterpart with a 10 times greater natural frequency (e.g., from 20t at a frequency multiplied by 10 to 14.5t at a frequency multiplied by 6), permitting economical design of the oscillating frame for a corresponding reduction of cost. It also becomes possible to provide an oscillating frame of compact construction which requires a reduced space even in the case of an oscillator having a high frequency. Further, the preclusion of resonance of the oscillating frame and rippling at the surface of molten steel bring about operational and other advantages.

Figure 11:
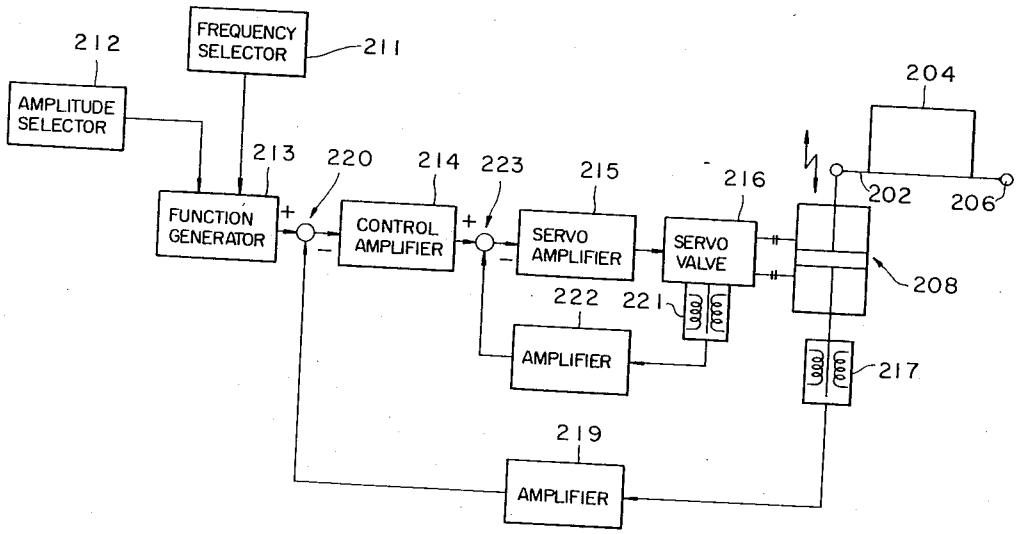
FIG. 11 is a block diagram of a conventional mold oscillation control circuit.

In controlling the electrohydraulic servo, it has been the conventional practice to employ a control circuit as shown in FIG. 11, in which indicated at 211 is a frequency selector, at 212 and amplitude selector, at 213 a function generator, at 214 a control amplifier, and at 215 a servo amplifier. A position signal of the cylinder of the electrohydraulic servo 208, which is produced by a differential transformer 217, is amplified at amplifier 219 and fed to an adding point 220 to detect its deviation from the output signal of the function generator 213. The detected amount of deviation is amplified at the control amplifier 214 and fed to another adding point 223 to detect its deviation from an output signal of an amplifier 222 which amplifies the position signal of the spool of a servo valve 216, which in turn is produced by another differential transformer 221. The resulting deviation signal is fed to the servo amplifier 215, driving the cylinder 218 according to the output signal of the function generator 213 by the servo valve 216 to oscillate the oscillating frame 202 to thereby apply oscillation to the mold 204.

As mentioned hereinbefore, the rate of occurrence of oscillation defects in the continuously cast strand can be reduced by increasing the frequency of vibration of the mold. However, with the control circuit shown in FIG. 11, if the frequency of the output of the function generator 213 is increased from about 1 Hz to about 30 Hz, the amplitude of oscillation of the oscillating frame 202 is increased abnormally at a frequency which coincides with the natural frequency of the oscillation system of the oscillating frame 202, for example, in the vicinity of 15 Hz. After that, the amplitude is attenuated, making it difficult to obtain an amplitude of a preset value in a high frequency range of approximately 30 Hz. If the gains of the amplifier 214 and servo amplifier 215 are changed to make up for the above-mentioned attenuation in amplitude of the oscillating frame 202, there will occur changes in the stable operating condition of the control system, which may lead to dissipation of the control system itself.

Figure 12:
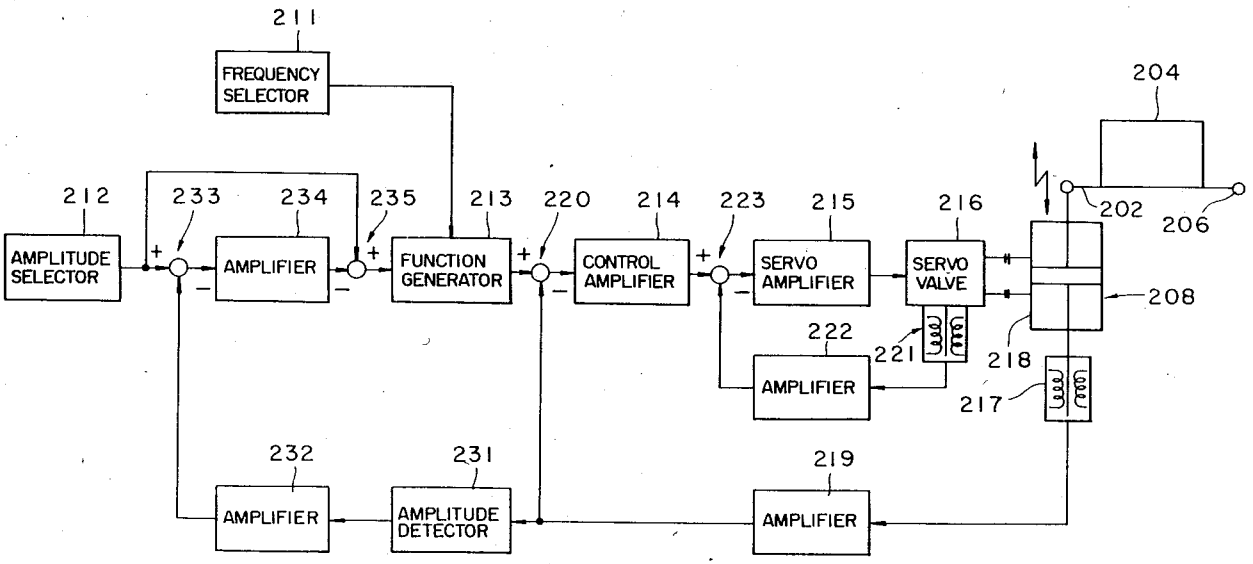
FIG. 12 is a block diagram of a mold oscillation control circuit according to the present invention.

Referring to FIG. 12, there is shown a control circuit according to the present invention, in which the component parts common to FIG. 11 are designated by like reference numerals. In FIG. 12, denoted at 231 is an amplitude detector, at 232 an amplifier, at 233 an adding point, at 234 an amplifier, and at 235 an adding point. The amplitude detector 231 constitutes a circuit which converts the position signal of the cylinder 218 from the amplifier 219 into a signal indicative of the amplitude of the cylinder 218. This amplitude signal is fed to the adding point 233 after amplification at the amplifier 232.

The adding point 233 constitutes a deviation detector which detects the amount of deviation $\epsilon$ of the amplitude signal of the cylinder 218 amplified by the amplifier 232, from the signal of the preset amplitude fed from the amplitude selector 212. The deviation $\epsilon$ is fed to an amplifier 234 operating on a predetermined amplification rate K to produce an output signal of $K\epsilon$. The signal $K\epsilon$ and the signal of the preset amplitude from the amplitude selector 212 are fed to the adding point 235 which is constituted by an adder, and the output signal of the adding point 235 is fed to the function generator 213 as a fresh amplitude signal.

The foregoing circuit arrangement can oscillate the cylinder 218 correctly in amplitude conforming with the signal of a preset amplitude from the amplitude selector 212 in contrast to the conventional control circuit of FIG. 11 in which the cylinder 218 is in some cases oscillated an amplitude, for example, of 1.5 mm even when the amplitude selector 212 produces an output signal of a preset amplitude of 3 mm. More specifically, in the control circuit of FIG. 12, the amplitude of 1.5 mm of the oscillation of the cylinder 218 is detected by the amplitude detector 231, and the detected value is fed to the amplifier 232 which supplies to the adding point 233 a signal corresponding to the amplitude of 1.5 mm. At the adding point 233, the signal is added to the amplitude signal of 3 mm from the amplitude selector 212 to produce a signal corresponding to the value of $(3-1.5)=1.5$ mm. This signal is amplified by the amplifier 234 which, if its amplification rate is $K=1$, produces and supplies to the adding point 235 a signal corresponding to 1.5 mm.

At the adding point 235, the signal of 1.5 mm from the amplifier 234 is added to the signal of 3 mm of the preset amplitude from the amplitude selector 212 to feed a fresh amplitude signal of $(1.5+3)=4.5$ mm to the function generator 213. This means that the signal of preset amplitude to be fed to the function generator 213 is increased from 3 mm to 4.5 mm in the case of the control circuit of FIG. 11, and permits oscillation of the cylinder 218 with an amplitude of 3 mm. In this instance, no change occurs to the function to be transmitted through the control system downstream of the function generator 213 so that there is no possibility of disturbing the operational stability.

When the amplitude of the cylinder 218 is 3 mm, and when this amplitude is the same as the amplitude of the preset amplitude signal from the amplitude selector 212, the deviation of both amplitudes is zero, which means that the abovementioned preset amplitude signal from the amplitude selector 212 directly inputs to the function generator 213 from the adder 235. Thus the cylinder 218 is oscillated by the preset amplitude signal inputing into the function generator 213.

By controlling the amplitude signal to be fed to the function generator 213 according to the amplitude of vibration of the cylinder 218 in this manner, the cylinder 218 can be oscillated an amplitude which is preset by the amplitude selector 212, without changing the transfer function of the oscillation control system of the cylinder 218. In the embodiment of FIG. 12, the amplification rate K is determined according to the amplitude as preset by the amplitude selector 212.

Figure 13:
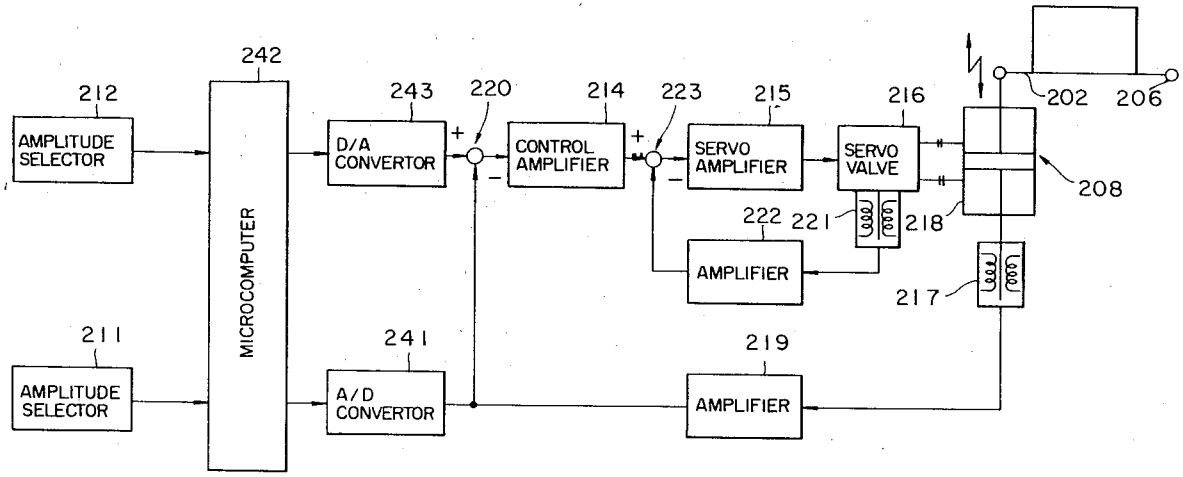
FIG. 13 is a view similar to FIG. 12 but showing a mold oscillation control circuit of a modified form.

Referring to FIG. 13, there is shown a control circuit of a modified form which differs from the circuit of FIG. 12 in that a digital signal processor is employed for correcting the amplitude signal to be produced by the amplitude selector 212. In the circuit diagram of FIG. 12, indicated at 241 is an A/D converter for picking up the amplitude of oscillation of the cylinder 218 as a digital signal, at 242 a microcomputer, and at 243 a D/A converter for producing a oscillational wave signal of the cylinder 218 according to the digital signal from the microcomputer 242.

Figure 14:
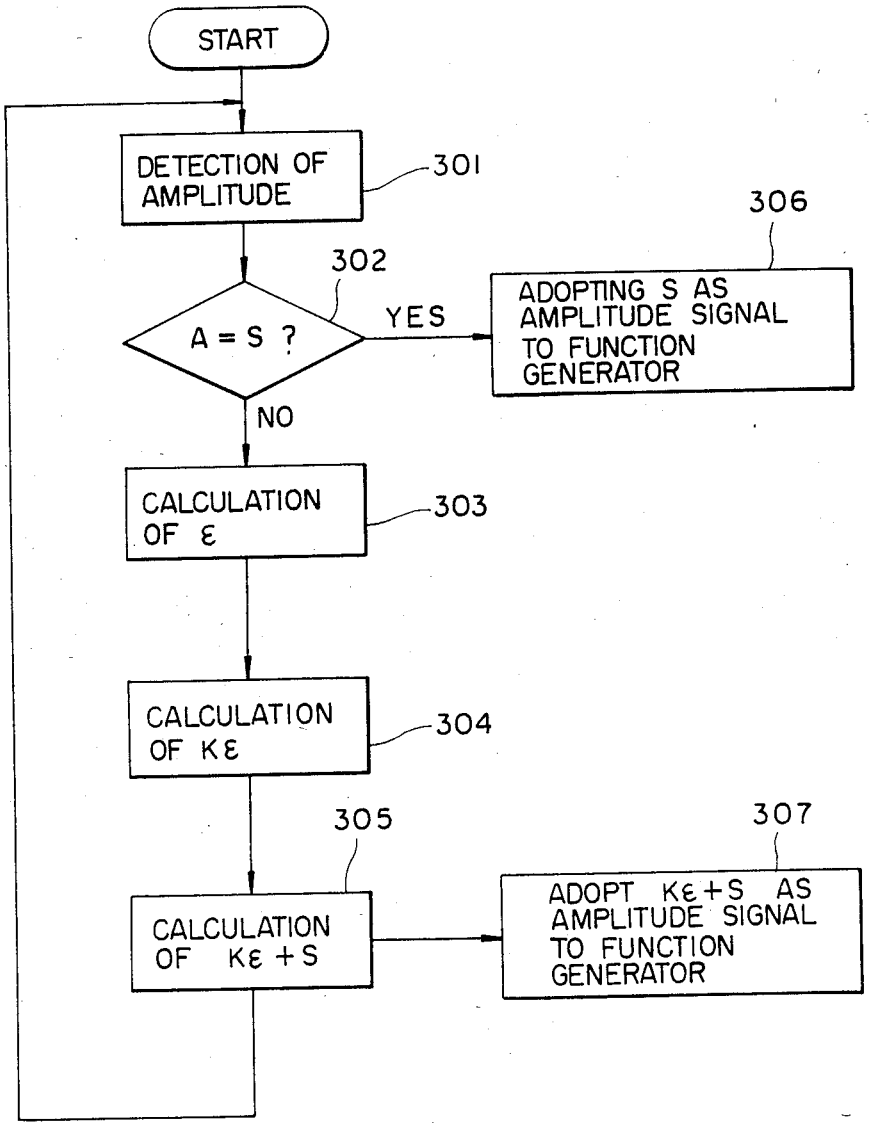
FIG. 14 is a flowchart showing the steps of operation by the microcomputer employed in the circuit of FIG. 13.

The microcomputer 242 is adapted to carry out the steps 201 to 207 of the flowchart shown in FIG. 14 to control the amplitude of the oscillational wave signal of the D/A converter 243 in such a manner that the amplitude A of oscillation of the cylinder 218 conforms with the preset amplitude signal S from the amplitude selector 212. In this instance, the microcomputer 242 judges whether or not $A=S$ and, if $A=S$, sends out the signal S as a fresh amplitude signal. If $A\neq S$, it produces a signal of $K\epsilon+S$ as a fresh amplitude signal, thereby constantly maintaining the amplitude of oscillation of the cylinder 218 in conformity with the amplitude which has been preset by way of the amplitude selector 212.

As is clear from the foregoing description, the mold oscillation control circuit according to the present invention is adapted to correct the value of the preset amplitude by seemingly increasing a preset value of amplitude when the amplitude of oscillation of the mold is smaller than the preset value, without changing the transfer function of the control system, so that the mold can be oscillated a sufficiently large amplitude by the control system even in a high frequency range in the vicinity of 30 Hz. Further, this can be attained simply by adding relatively simple components externally to the conventional mold oscillation control system.

Although the invention has been described in terms of specific embodiments, it is to be understood that other forms of invention may be readily adapted within the scope of the invention as defined in the appended claims.

What is claimed is:

1. A method of an oscillating frame system with continuous casting by the use of a mold oscillating device adapted to oscillate a mold supported on an oscillating frame, which comprises:

oscillating said mold by applying vibration at a low amplitude and a preselected frequency higher than a natural frequency of the oscillating frame system; and thereafter, increasing the amplitude of said applied vibration to a value in a range as determined in accordance with a ratio of a length of time of downward movement of said mold to a length of time in which the speed of movement of said mold exceeds casting speed during said downward period of movement of said mold.

2. The method as set forth in claim 1, wherein said preselected frequency is approximately 1.5 times higher than said natural frequency of said oscillating frame system.

3. A method of continuous casting by the use of an oscillating system adapted to oscillate a mold supported on an oscillating frame substantially of U-shape in plan view having free ends of opposite side frame portions thereof pivotally supported on a pivoting shaft and adapted to be oscillated up and down by an oscillator connected to a center portion of a transverse frame portion thereof, wherein said method comprises:

determining the rigidity of said oscillating frame such that a natural frequency of said oscillating frame is at least 6 times greater than the frequency of oscillating applied by said oscillator; and oscillation said mold.

4. A method of continuous casting as set forth in claim 3, wherein said oscillator further comprises an electrohydraulic servo unit having a cylinder thereof connected to said oscillating frame and driven according to an oscillation signal of preselected amplitude and frequency produced by a function generator to oscillate said mold, wherein said method further comprises:

converting a position signal of said cylinder into an amplitude signal;

calculating an amount of deviation of said amplitude signal from the value of said preselected amplitude;

multiplying the amount of deviation by a coefficient to determine a value and adding said value to said preset amplitude to produce a second amplitude signal to be applied to said function generator.

5. A continuous casting apparatus with a mold oscillating system adapted to put a casting mold in oscillation at a preselected amplitude and frequency, said oscillation system comprising:

an oscillating frame substantially of U-shape in plan view and having a pivoting shaft and an oscillator, free ends of opposite side frame portions thereof being pivotally supported on such pivoting shaft and oscillated up and down by said oscillator wherein said oscillator is connected to a center portion of a transverse frame portion thereof;

an oscillation control circuit connected to said oscillator to control oscillator of said mold;

wherein said oscillator further comprises an electrohydraulic servo having a cylinder, said cylinder being connected to said oscillating frame and driven according to a signal of preselected amplitude and frequency produced by said control circuit;

wherein said control circuit further comprises:

a function generator for generating a control signal of preselected amplitude and frequency and for inputting said control signal to said electrohydraulic servo;

an amplitude detector for converting a position signal of said cylinder to an amplitude signal;

a deviation detector for calculating an amount of deviation of said amplitude signal from said preselected amplitude;

a multiplier for multiplying said amount of deviation by a coefficient to produce a first result; and an adder for adding said first result to said preselected amplitude to produce a second result and for inputting said second result to said function generator.

* * * * *